US006354098B1

(12) United States Patent
Bardin et al.

(10) Patent No.: US 6,354,098 B1
(45) Date of Patent: Mar. 12, 2002

(54) COOLER

(75) Inventors: James R. Bardin, Atlanta; Ronald Wayne Steele, Powder Springs, both of GA (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 09/504,702

(22) Filed: Feb. 16, 2000

(51) Int. Cl.[7] ..... A47F 3/04
(52) U.S. Cl. ..... 62/250; 221/124; 221/281
(58) Field of Search ..... 62/440, 250; 221/124, 221/132, 150 R, 281

(56) References Cited

U.S. PATENT DOCUMENTS

| | | | | |
|---|---|---|---|---|
| 1,178,326 | A | | 4/1916 | Lichtenberg |
| 2,279,093 | A | | 4/1942 | Peters ..... 312/48 |
| 2,311,449 | A | | 2/1943 | Lilly ..... 312/36 |
| 2,327,379 | A | | 8/1943 | Thomas ..... 211/74 |
| 2,332,214 | A | | 10/1943 | Foprsthoefel et al. ..... 312/45 |
| 2,440,902 | A | | 5/1948 | Lutey ..... 224/45 |
| 2,620,691 | A | | 12/1952 | Gould ..... 81/3.1 |
| 2,880,904 | A | | 4/1959 | Linthicum ..... 221/125 |
| 2,919,814 | A | | 1/1960 | Berkowitz ..... 211/74 |
| 3,055,293 | A | | 9/1962 | Lariccia ..... 101/44 |
| 3,231,110 | A | | 1/1966 | Bossell et al. ..... 214/77 |
| 3,243,220 | A | | 3/1966 | Karas ..... 294/87.28 |
| 3,286,846 | A | | 11/1966 | Brandes ..... 211/49 |
| 3,318,455 | A | | 5/1967 | Takahashi ..... 211/49 |
| 3,454,168 | A | | 7/1969 | Chan ..... 211/134 |
| 3,471,210 | A | | 10/1969 | Barroero ..... 312/329 |
| 3,501,016 | A | | 3/1970 | Eaton ..... 211/49 |
| 3,553,927 | A | | 1/1971 | Anglade, Jr. ..... 53/26 |
| 3,606,024 | A | | 9/1971 | Mieville ..... 211/176 |
| 3,805,964 | A | | 4/1974 | Titus, Jr. ..... 211/49 D |
| 3,900,112 | A | | 8/1975 | Azzi et al. ..... 211/148 |
| 4,022,363 | A | | 5/1977 | Eliassen ..... 224/45 AA |
| 4,072,246 | A | | 2/1978 | Paulin ..... 221/307 |
| 4,228,905 | A | | 10/1980 | Cammarota ..... 211/71 |
| 4,310,097 | A | | 1/1982 | Merl ..... 211/49 D |
| 4,318,485 | A | * | 3/1982 | Clement ..... 211/49 D |
| 4,367,818 | A | | 1/1983 | Suttles ..... 211/49 D |
| 4,383,614 | A | | 5/1983 | Miller ..... 211/49 D |
| 4,394,910 | A | | 7/1983 | Miller ..... 211/49 D |
| 4,401,221 | A | | 8/1983 | Suttles ..... 211/49 D |
| 4,405,052 | A | | 9/1983 | Spiros ..... 211/49 D |
| 4,478,337 | A | | 10/1984 | Flum ..... 211/49 D |
| 4,763,796 | A | | 8/1988 | Flum ..... 211/59.2 |
| 4,917,264 | A | | 4/1990 | Gasiel et al. ..... 221/124 |
| 4,977,754 | A | * | 12/1990 | Upton et al. ..... 221/150 R |
| 5,078,459 | A | | 1/1992 | Sclater ..... 312/45 |
| 5,209,358 | A | | 5/1993 | Simard ..... 211/74 |
| 5,259,518 | A | | 11/1993 | Sorenson et al. ..... 211/59.2 |
| 5,269,156 | A | * | 12/1993 | Van de Velde et al. .... 62/457.4 |
| 5,279,430 | A | | 1/1994 | Benton ..... 211/151 |
| 5,445,287 | A | * | 8/1995 | Center et al. ..... 221/150 R |
| D367,864 | S | | 3/1996 | Lacewell ..... D15/85 |
| 5,567,026 | A | | 10/1996 | Lacewell ..... 312/135 |
| 5,586,665 | A | | 12/1996 | Brousseau ..... 211/59.2 |
| 5,586,687 | A | | 12/1996 | Spamer et al. ..... 221/298 |
| D377,800 | S | | 2/1997 | Branz et al. ..... D15/85 |
| D383,796 | S | | 9/1997 | Rinicella et al. ..... D20/42 |
| 5,669,527 | A | | 9/1997 | Hardy ..... 221/191 |
| 5,695,074 | A | | 12/1997 | Wiese ..... 211/59.2 |

(List continued on next page.)

FOREIGN PATENT DOCUMENTS

| | | |
|---|---|---|
| DE | 298 03 105 | 7/1998 |
| EP | 0 903 549 | 3/1999 |
| WO | WO 01/00065 | 1/2001 |

*Primary Examiner*—Henry Bennett
*Assistant Examiner*—Mohammad M. Ali
(74) *Attorney, Agent, or Firm*—Sutherland Asbill & Brennan LLP

(57) ABSTRACT

A cooler with an insulated shell and a product loading system. The insulated shell has an access portion and a loading portion. The product loading system has a gravity-feed loading element and a dispensing cup.

40 Claims, 8 Drawing Sheets

U.S. PATENT DOCUMENTS

| | | | | | |
|---|---|---|---|---|---|
| 5,695,075 | A | | 12/1997 | Flum et al. | 211/59.2 |
| 5,706,957 | A | * | 1/1998 | Hardy | 211/59.2 |
| 5,706,958 | A | | 1/1998 | Spamer | 211/59.2 |
| 5,706,978 | A | | 1/1998 | Spamer et al. | 221/298 |
| D395,968 | S | | 7/1998 | Shappell | D6/509 |
| D402,138 | S | | 12/1998 | Trulaske, Sr. | D6/470 |
| 5,865,326 | A | | 2/1999 | Spamer et al. | 211/181.1 |
| 5,875,919 | A | | 3/1999 | Spamer et al. | 221/289 |
| 5,878,862 | A | | 3/1999 | Dewsnap | 193/27 |
| 5,878,894 | A | | 3/1999 | Robertson | 211/59.2 |
| 5,947,303 | A | | 9/1999 | Robolin | 211/59.2 |
| 5,957,327 | A | | 9/1999 | Whiten | 221/289 |
| 5,967,367 | A | * | 10/1999 | Orsborn | 222/30 |
| 5,971,204 | A | | 10/1999 | Apps | 221/92 |
| 6,079,216 | A | * | 6/2000 | de Marsillac Plunket | 62/56 |
| 6,131,399 | A | * | 10/2000 | Hall | 221/150 R |

* cited by examiner

COOLER

TECHNICAL FIELD

The present invention relates generally to coolers and refrigerators and more particularly relates to coolers that store and dispense consumer products in a first in and first out manner.

BACKGROUND OF THE INVENTION

Two major goals in cooler design and construction are (1) marketing and (2) efficiency. By marketing, we mean that the cooler and the products therein should be visually appealing so as to catch the eye of the consumer. Further, the cooler may provide advertising space and indicia thereon so as to promote the use and sale of the products therein. By efficiency, we mean that the cooler should take up no more space than necessary, that the cooler should promote product usage and storage in a consistent manner, i.e., in a first in and first out manner, and that the energy usage should be reasonable.

These goals are sometimes in competition with one another. For example, it is common to make the door on the cooler as large as possible such that the consumer can see all the products therein. The use of a large door, however, may limit the amount of space available on the exterior of the cooler for advertising and may not promote the usage of the products therein in the first in and first out manner. Conversely, coolers with first in and first out mechanisms are known. These mechanisms, however, generally limit the available space for promoting the products and may be difficult to use or restock.

What is needed, therefore, is a cooler that promotes product usage in a first in and first out manner while also providing sufficient interior product space and sufficient exterior marketing space. The cooler also should be efficient in terms of size and overall energy usage. These goals should be accomplished in a cooler that is reasonable in terms of cost of manufacture and cost of usage.

SUMMARY OF THE INVENTION

The present invention thus provides a cooler with an insulated shell and a product loading system. The insulated shell has an access portion and a loading portion. The product loading system has a gravity-feed loading element and a dispensing cup. The use of the access portion and the loading portion provides for first in and first out loading and may provide for zoned cooling. The use of the gravity feed loading element and the dispensing cup allows for easy removal of a product from the cooler. The cooler also provides for increased visibility and marketing.

Specific embodiments of the present invention provide for both the access portion and the loading portion having a chilled temperature. Alternatively, the loading portion may have an ambient temperature. The insulated shell may include a wall positioned therein between the access portion and the loading portion. An access door may be positioned on the insulated shell adjacent to the access portion while a loading door may be positioned on the insulated shell adjacent to the loading portion. The loading door may include an advertising panel and also may have a substantially convex shape. The cooler may have a number of loading portions with a number of loading doors. Specifically, the cooler may have a loading portion positioned on either side of the access portion with a convex loading door positioned adjacent to each of the loading portions. The convex loading doors define a chamber adjacent to the access door. The cooler may have advertising indicia positioned thereon.

The gravity-feed loading element may include a neck tracker tube. The neck tracker tube may have a U-shape with a loading end positioned within the loading portion and one or more dispensing ends or tubes positioned within the access portion. The loading end may be elevated from the dispensing ends by about seven to about nine degrees. The dispensing cup may be positioned adjacent to each of the dispensing ends of the neck tracker tube. The dispensing cup may have a base and a support rail. The product loading system may have a number of the gravity-feed loading elements and a number of the dispensing cups.

A number of the products, such as bottles, may be positioned within the product loading system. The cooler also may have a light emitting diode positioned within the access portion. The cooler also may have a scuff panel positioned about the insulated shell.

A further embodiment of the present invention may provide a loading system for a number of bottles in a cooler. The loading system may include a gravity feed element having a loading end and one or more dispensing ends. A dispensing cup may be positioned adjacent to each of the dispensing ends. The gravity feed elements may be in the form of a neck tracker tube. Each of the bottles includes a neck portion and a base portion. The neck tracker tube may have a C shape so as to support each of the bottles by the neck portion. The dispensing cup may have a base so as to support each of the bottles by the base portion.

The loading end of the gravity feed element has a higher position than the dispensing end such that the bottles slide from the loading end to the dispensing end. Likewise, the loading end of the gravity feed element may have an ambient temperature while the dispensing end may have a chilled temperature. The dispensing cup extends beyond the gravity feed element such that the gravity feed element does not interfere with the removal of one of the bottles from the dispensing cup. The loading system may have a number of gravity feed elements and a number of dispensing cups.

A method of the present invention provides for storing a number of the products in a cooler. The cooler may have a product loading system extending from a loading end to a dispensing end and may have a dispensing cup positioned adjacent to the dispensing end. The method includes the steps of loading the products into the loading end of the product loading system, sliding the products from the loading end to the dispensing end, sliding a first one of the products from the dispensing end of the product loading system to the dispensing cup, and removing the first one of the products from the dispensing cup. The method may further include the step of sliding a second one of the products from the product loading system to the dispensing cup after the first one of the products has been removed.

A further embodiment of the present invention provides a cooler for housing a number of products. The cooler includes an insulated shell, an access door, and a light emitting diode positioned therein. The light emitting diode illuminates the products within the cooler. The cooler may have a number of the light emitting diodes.

Other objects, features, and advantages of the present invention will become apparent upon review of the following detailed description of the preferred embodiments of the invention, when taken in conjunction with the drawings and the appended claims.

DETAILED DESCRIPTION OF THE INVENTION

Figure 1:
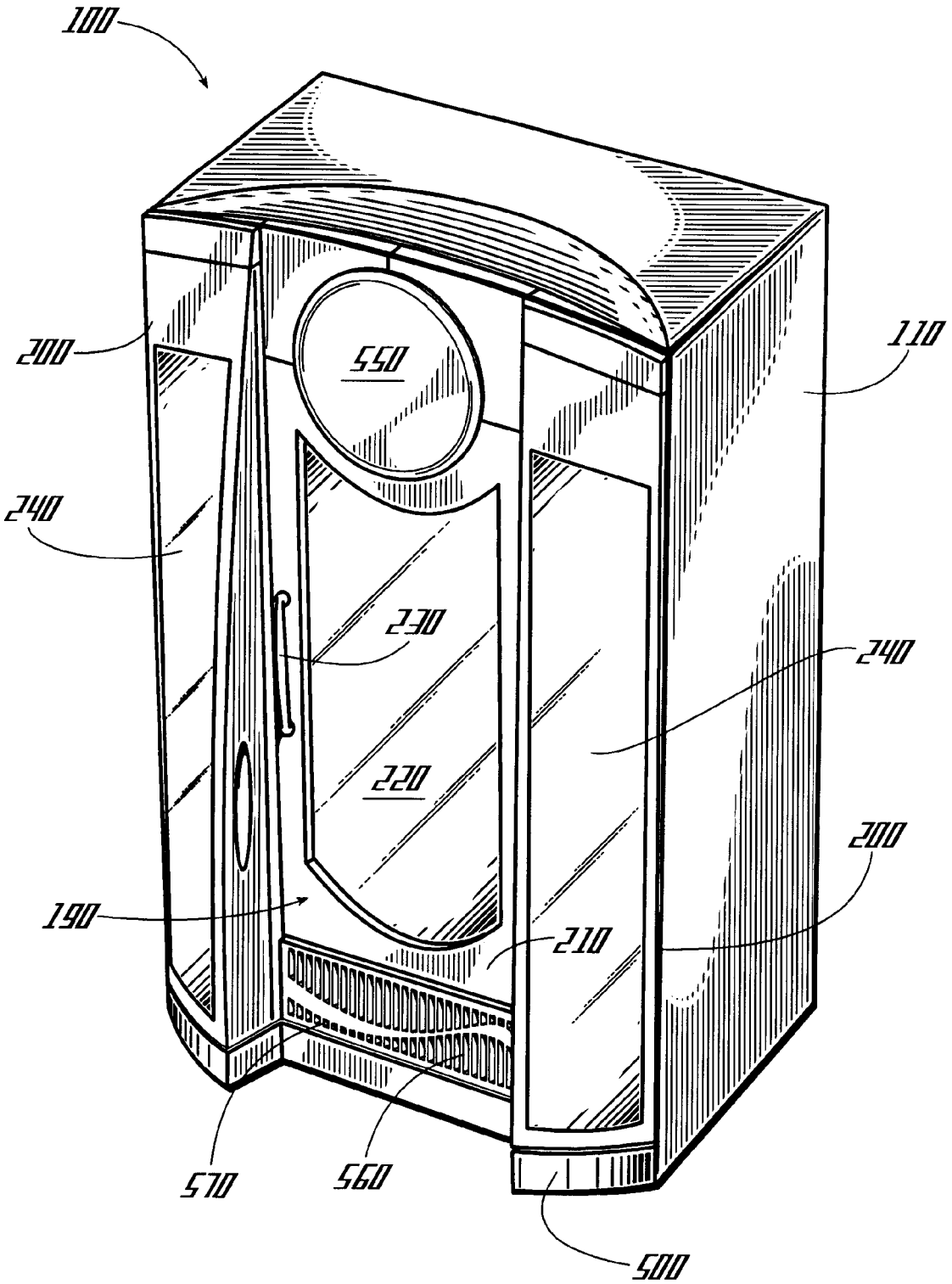
FIG. 1 is a perspective view of the cooler of the present invention.
Figure 2:
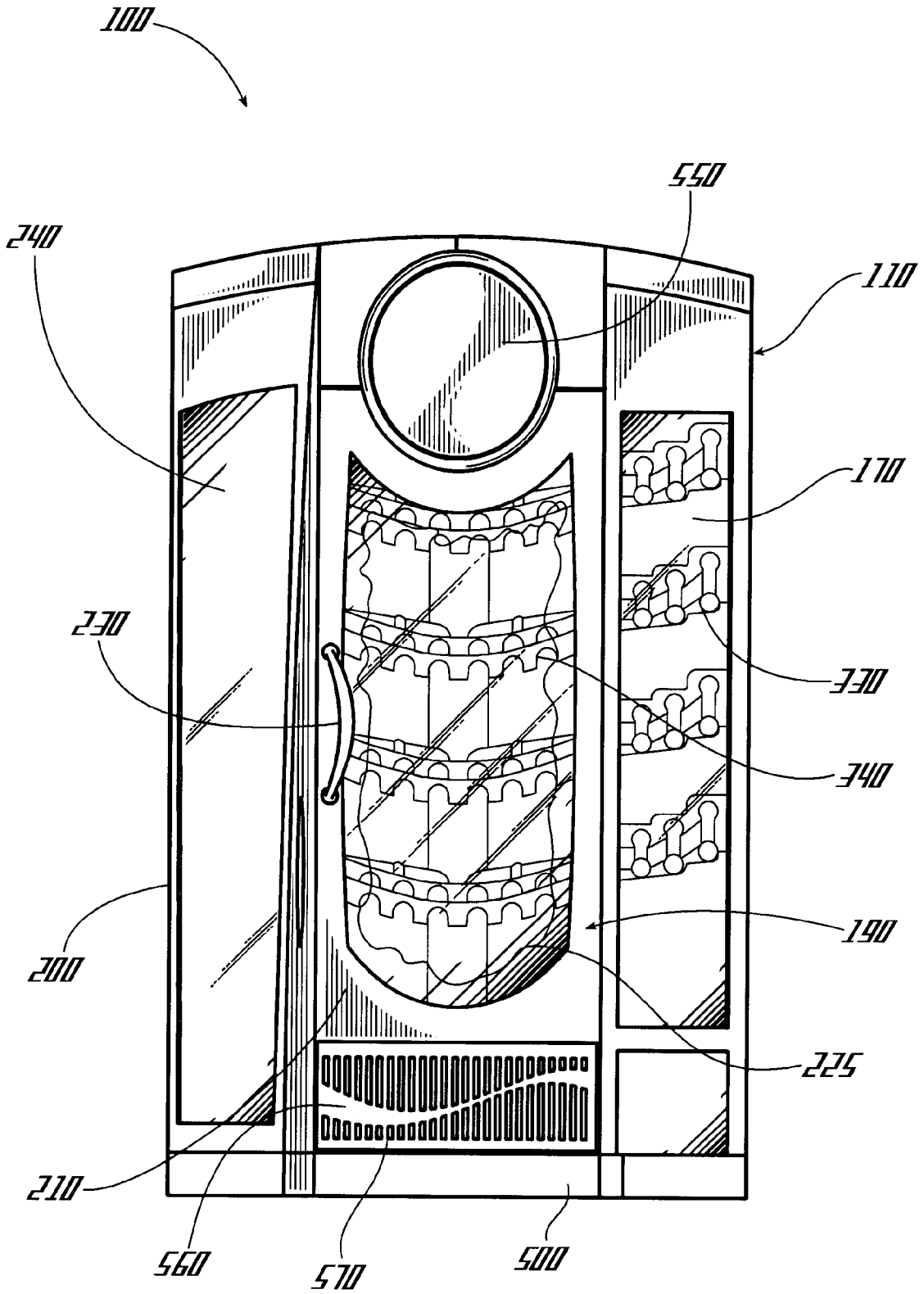
FIG. 2 is a front plan view of the cooler of the present invention with one of the loading sections visible.

Referring now in more detail to the drawings, in which like numerals refer to like elements throughout the several views, FIGS. 1–5 show a cooler 100 of the present invention. The cooler 100 may have an insulated shell 110 enclosing an interior portion 120. The insulated shell 110 may be largely of conventional design and materials. Although a substantially rectangular shape is shown, any convenient shape and size may be used. The insulated shell 110 may be similar to that sold by the Beverage-Air Company of Spartanburg, S.C. with coolers under the mark "MT-45" or "Marketeer". The insulated shell 110 may be made from a conventional combination of metals, foams, plastics, or similar types of materials.

The cooler 100 also may have a conventional refrigeration system 130 positioned therein or adjacent thereto so as to chill the interior portion 120. As is well known in the art, the refrigeration system 130 may include a compressor 140, an evaporator 150, a fan 160, and other types of conventional cooling components. The size and capacity of the refrigeration system 130 is related to the size and use of the cooler 100 as a whole. The compressor 140 may have a capacity of about 0.1 to about 0.75 horsepower. The entire interior portion 120 of the cooler 100 maybe chilled by the refrigeration system 130. Alternatively, the interior portion 120 of the cooler 100 may include a refrigerated access section 125 and also one or more loading sections 170. As is shown, the access section 125 and the loading sections 170 may be divided by one or more walls 180. The respective sizes and shapes of the access section 125 and the loading sections 170 may vary. The walls 180 may have one or more passageways permitting movement therethrough while limiting thermal transfer. The loading sections 170 may or may not be refrigerated.

The insulated shell 110 may be enclosed by an access door 190 and by one or more loading doors 200. The access door 190 is preferably transparent in whole or in part, such that the consumer can see within the cooler 100. The access door 190 may swing open, slide open, or open in any conventional fashion. The access door 190 is preferably positioned in front of the access section 125 of the cooler 100. The access door 190 preferably has an outer frame 210 enclosing a transparent panel 220. The outer frame 210 may be made from metals, plastics, or similar types of materials. The access door 190 may be insulated. The transparent panel 220 may be made from single or multiple paned 165 glass or any other type of transparent materials with good insulating capabilities. For example, polycarbonate, ABS, or other suitable materials may be used. A handle 230 may open the access door 190.

The transparent panel 220 may have "frosted" appearance 225 around its periphery. This frosted appearance 225 is intended to provide the connotation of coldness to the consumer. The frosted appearance 225 may be made by stencils, etching, chipping, or other means. The means by which to promote the connotation of coldness in the cooler 100 is described in commonly-owned U.S. patent application Ser. No. 09/401,084, entitled "Cooler with Transparent Door and Cold Appearance". U.S. patent application Ser. No. 09/401,084 is incorporated herein by reference.

Figure 4:
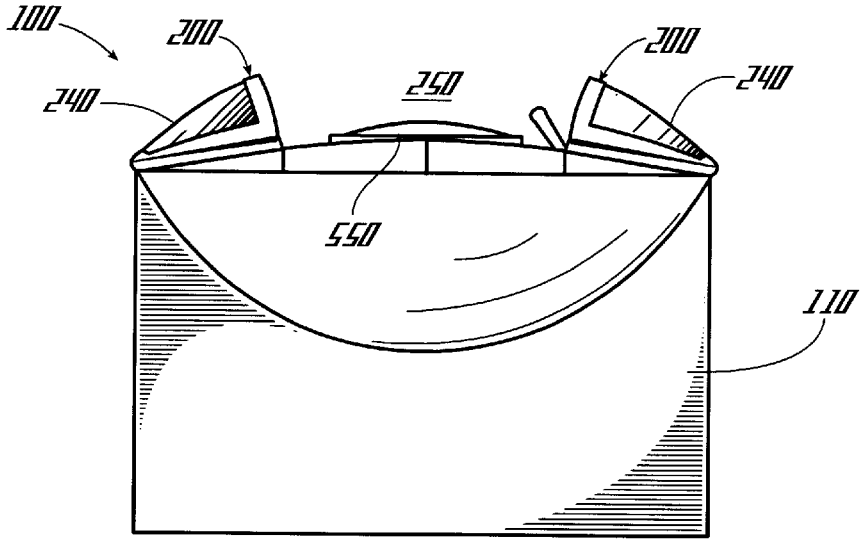
FIG. 4 is a side exploded view of the cooler of the present invention.

The loading doors 200 may be positioned adjacent to one or more of the loading sections 170 of the insulated shell 110. In this embodiment, one loading door 200 is positioned on either side of the access door 190. The loading doors 200 may have an opaque front panel 240. The panel 240 may be inscribed or covered with various types of advertising indicia thereon. As is shown in FIG. 4, the loading doors 200 may each have a substantially convex shape such that the panels 240 on each side of the door 190 may be seen at any orientation in front of the cooler 100. The panels 240 thus provide 180 degrees of visibility for the advertising indicia. Further, this convex shape of the panels 240 expands in the direction of the access door 190. This shape provides and defines a chamber 250 that draws the consumer towards the access door 190. Hinges or other types of conventional rotation means may attach the loading doors 200 to the insulated shell 110. The loading doors 200 may be made out of metals, plastics, or similar types of materials. The loading doors 200 may be insulated. The loading doors 200 also may have conventional locking means provided therein.

Positioned within the cooler 100 is a product loading system 300. As is shown in FIGS. 5 through 8, the product loading system 300 may include a gravity-feed loading system 310. In this embodiment, the gravity feed loading system 310 includes a plurality of neck tracker tubes 320. The neck tracker tubes 320 are essentially C-shaped tubes that extend from a higher loading end 330 to a lower dispensing end 340. The neck tracker tubes 320 extend in a largely U-shaped fashion from the loading section 170 to the access section 125. The neck tracker tubes 320 may be made of any substantially rigid material, such as conventional thermoplastics, metals, or the like. The loading end 330 and the dispensing end 340 may have an angle of about five (5) to about twenty (20) degrees therebetween, with about seven (7) to about (9) degrees in descent being preferred. Although six (6) neck tracker tubes 320 are shown herein, any number of the tubes 320 may be used within the cooler 100. Further, as many rows of the tubes 320 as desired may be used. The neck tracker tubes 320 may be rigidly supported by a series of support racks 345 or similar types of conventional support structures.

Positioned at the dispensing end 340 of each neck tracker tube 320 may be a dispensing cup 350. The dispensing cup 350 is positioned under the dispensing end 340 of the neck tracker tube 320 and extends beyond the tube 320. The dispensing cup 350 may be fixedly attached to the top of the lower neck tracker tube 320, the support rack 345, or otherwise fixedly attached within the cooler 100. As is shown, the dispensing cup 350 may have a base 360 and a support rail 370. Alternatively, the dispensing cup 350 may have any convenient shape. The dispensing cup 350 may be made of the same material as the neck tracker tubes 320 or any other substantially rigid material such as metals, plastics, or even foam.

The cooler 100 may be loaded with a plurality of products 400. The products 400 may be in the shape of a bottle 410 or in the shape of any object normally positioned or sold from within the cooler 100. The bottles 410 may be of conventional shape and may contain a carbonated soft drink or other type of beverage. Each bottle 410 may have an extended neck portion 420 and an expanded base portion 430.

In use, the cooler 100 may be loaded with the products 400 via the product loading system 300. To load the cooler 100, the loading doors 200 are opened and the products 400, the bottles 410, are positioned within the loading end 330 of each of the neck tracker tubes 320. The neck portion 420 of each bottle 410 fits within and is supported by the neck tracker tube 340. As the bottles 410 are positioned within the loading end 330 of the neck tracker tubes 320, the bottles 410 slide under the force of gravity down to the dispensing end 340 of the neck tracker tubes 320 and into the dispensing cups 350. As each bottle 410 approaches the dispensing end 340 and the dispensing cup 350, the bottle 410 slides out of the neck tracker tube 320 and is supported in the dispensing cup 350 by only its base portion 430. Once positioned within the dispensing cup 350, the bottle 410 and its extended neck portion 420 are clear of the neck tracker tube 340.

When a consumer desires one of the products 400, the consumer opens the access door 190 and removes one of the products 400, the bottle 410, from one of the dispensing cups 350. Because the bottle 410 is positioned completely within the dispensing cup 350, the consumer does not need to remove the bottle 410 from the neck tracker tubes 320. The use of the dispensing cup 350 thus provides a distinct consumer advantage in that consumers sometimes have had difficulty in removing the bottle 410 directly from the neck tracker tube 320. After a consumer removes one of the bottles 410 or other type of product 400, the next bottle 410 then slides into place in the dispensing cup 350. The use of the product loading system 300 thus provides for first in and first out loading and usage of the products 400 placed therein.

Figure 3:
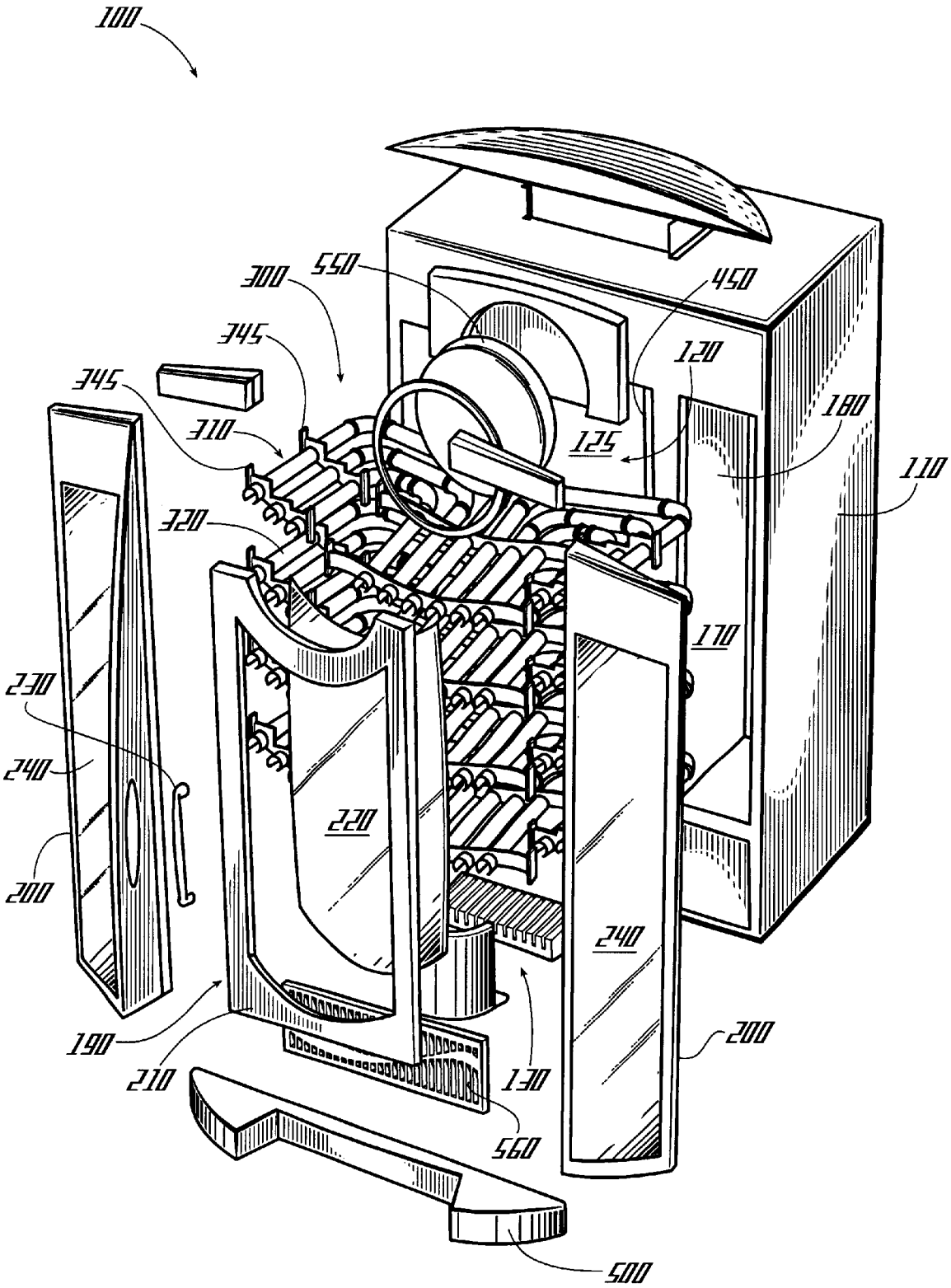
FIG. 3 is an front exploded view of the cooler of the present invention.
Figure 5:
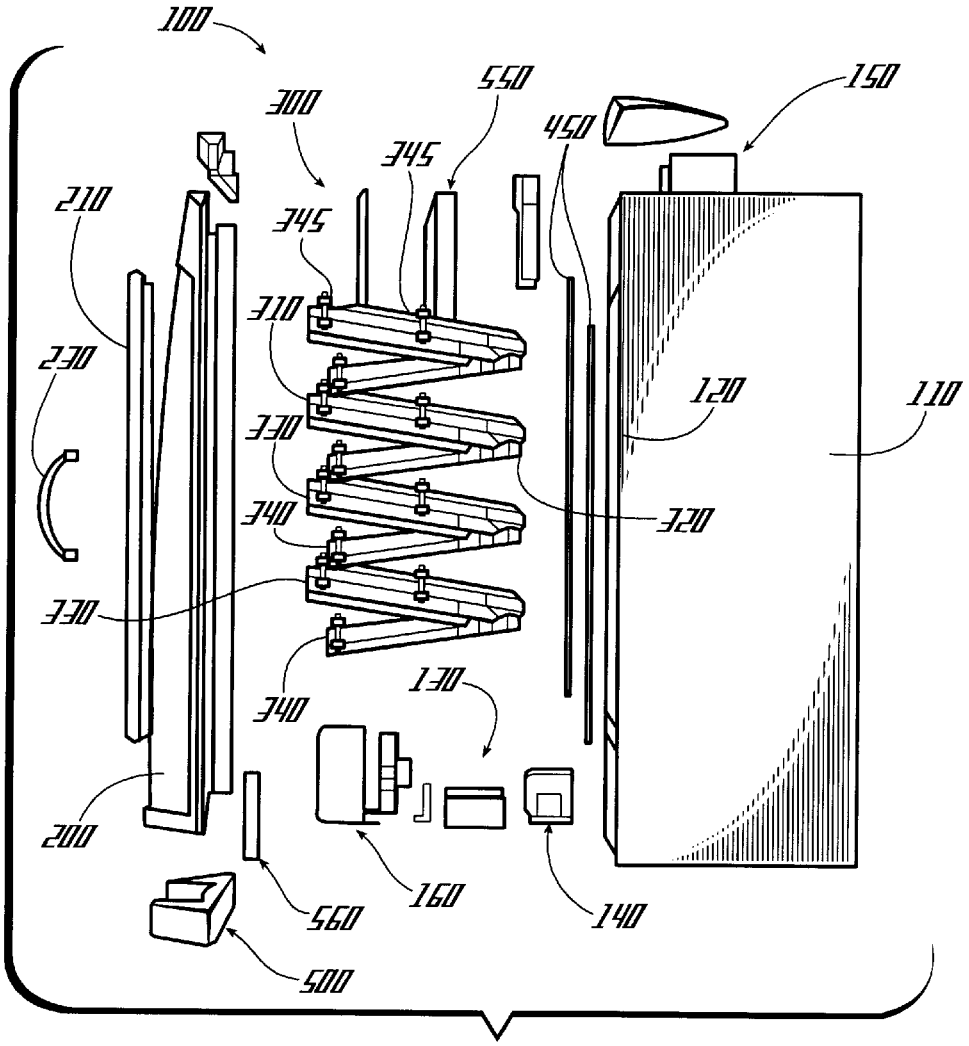
FIG. 5 is a top plan view of the cooler of the present invention.
Figure 6:
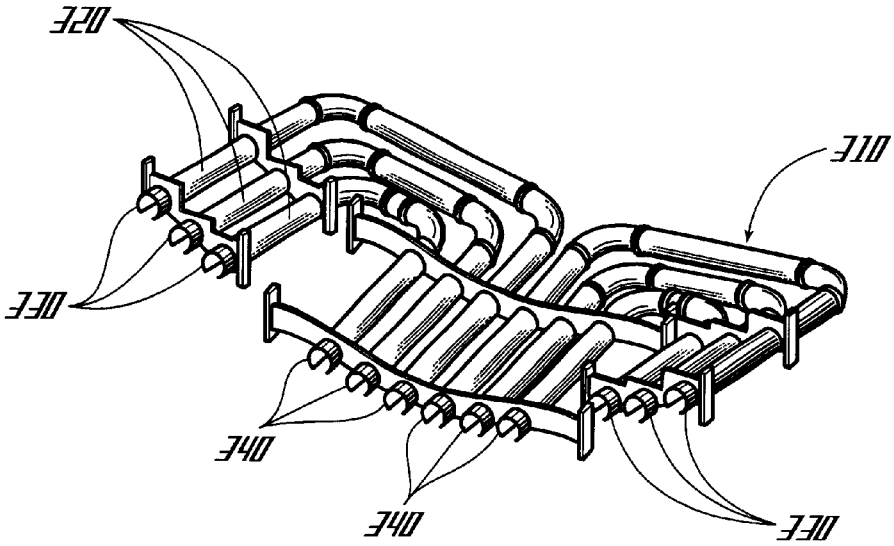
FIG. 6 is a perspective view of the product loading system of the present invention.
Figure 7:
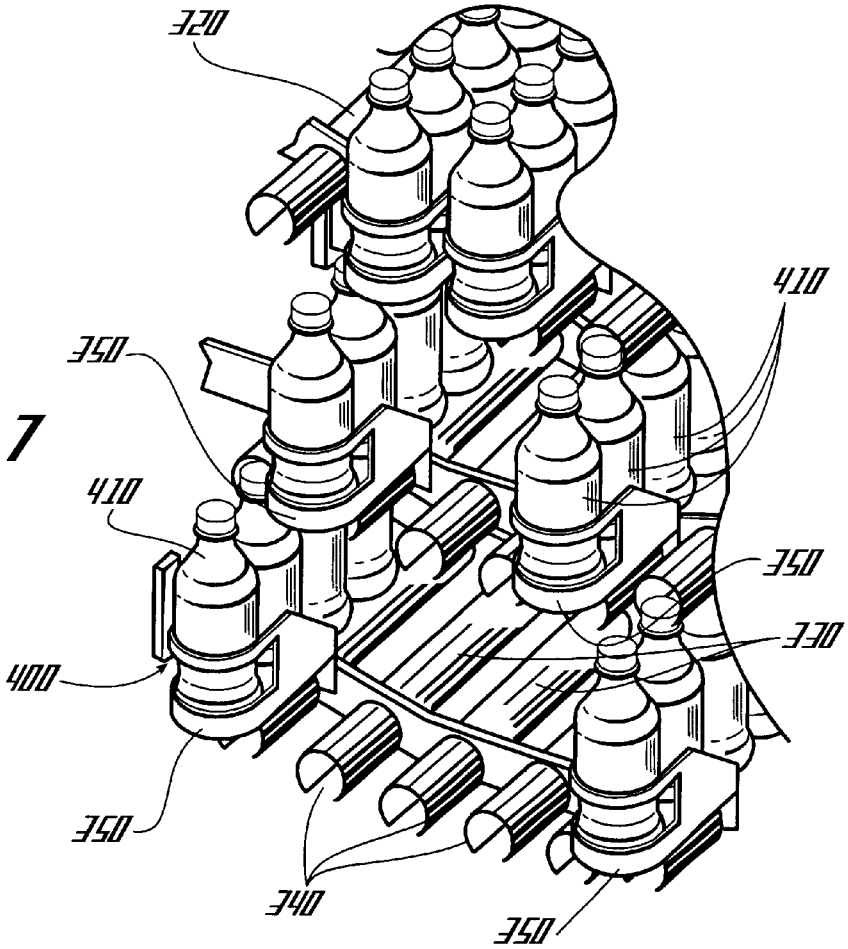
FIG. 7 is a perspective view of the products, the neck tracker tubes, and the dispensing cups of the present invention.
Figure 8:
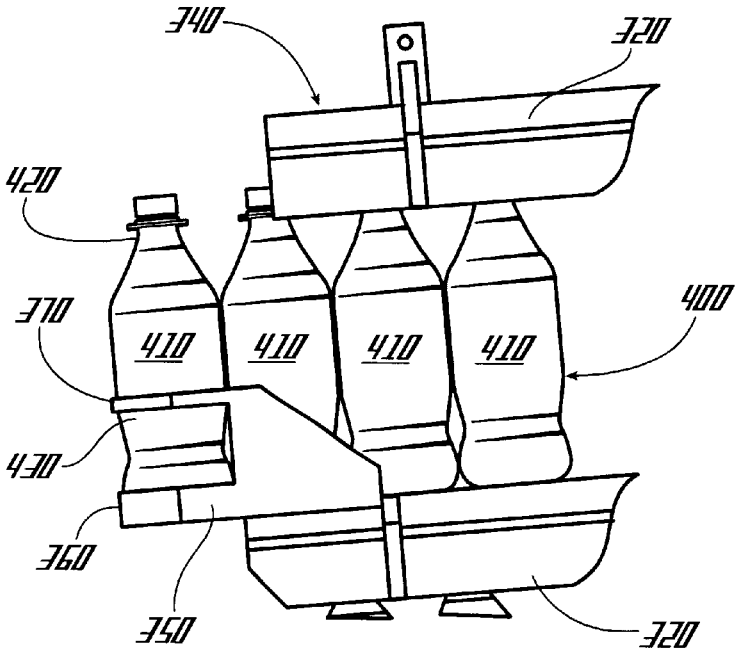
FIG. 8 is a side plan view of the products, the neck tracker tubes, and the dispensing cups of the present invention.
Figure 9:
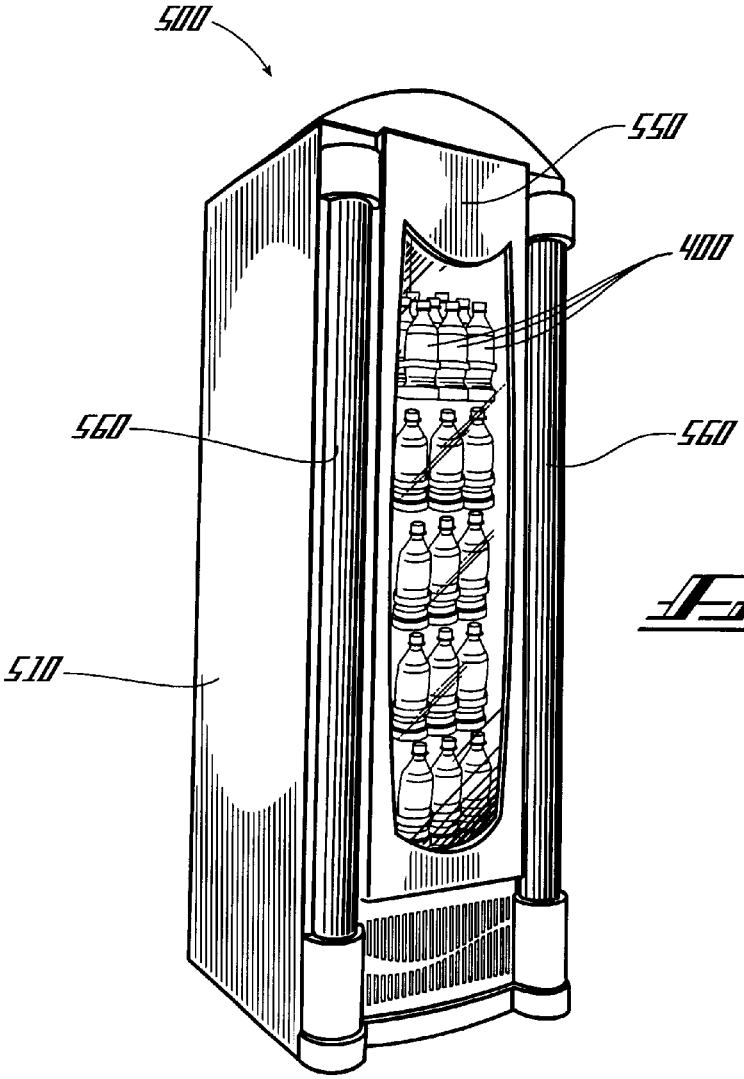
FIG. 9 is a perspective view of an alternative cooler of the present invention.
Figure 10:
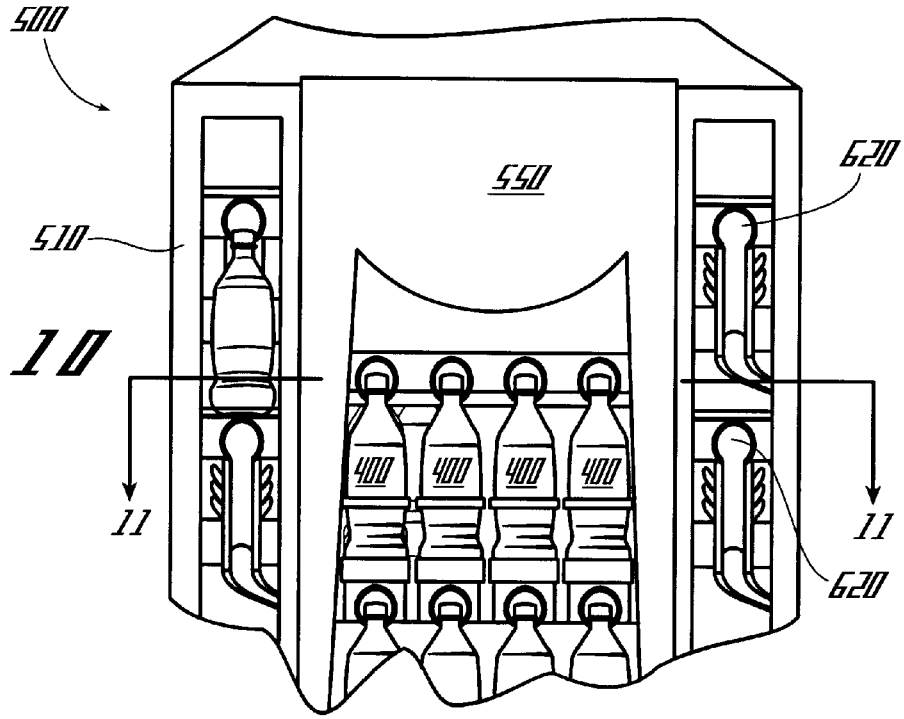
FIG. 10 is a plan view of the alternative cooler with the product loading system visible.

As shown in FIGS. 3 and 5, the interior portion 120 of the cooler 100 may have one or more of light emitting diodes ("LED's") 450 positioned therein. The LED's 450 may be positioned adjacent to the access door 190 or elsewhere within the cooler 100. The LED's 450 serve to illuminate the interior portion 120 of the cooler 100 and the products 400 positioned therein. The LED's 450 have a significantly longer lifetime than conventional fluorescent lighting or other conventional types of lighting sources generally used within the cooler 100. It may be expected for the LED's 450 to last as long as the cooler 100 itself. The LED's 450 generally also are smaller in size than conventional fluorescent lights. Further the use of the LED's 450 provides a significant increase in brightness and clarity as compared to conventional lighting techniques. The LED's 450 may have various colors such as blue, red, and green that may be used separately or together. A preferred LED 450 may be manufactured by Color Kinetics of Boston, Mass. under the mark ChromaCore. The LED's 450 also may be used with conventional lighting sources.

The cooler 100 also may have a scuff panel 500 positioned around its base. The scuff panel 500 may be positioned beneath the access door 190 and the loading doors 200 or the scuff panel 500 may extend all the way around the cooler 100. The scuff panel 500 is preferably made out of plastics, metals, or similar types of materials. The scuff panel 500 is preferably black or dark in color so as to hide scuffs and other marks.

The cooler 100 also may have various types of advertising indicia thereon. In addition to the loading doors 200, the cooler 100 also may have an advertising panel 550 positioned over the access door 190 and elsewhere. The advertising panel 550 allows various types of advertising to be formed therein or placed thereon. Advertising indicia also may be placed anywhere on the insulated shell 110, the access door 190, and the loading doors 200. Further, the cooler 100 also may have a vent 560 that is used in combination with the refrigeration system 130. The vent 560 may be of conventional design. Advertising indicia also may be placed thereon. In this embodiment, advertising indicia 570 in the form of the "Dynamic Ribbon" of The Coca-Cola Company of Atlanta, Ga. may be used. Any other type of advertising indicia 570 also may be used.

The cooler 100 of the present invention thus provides significant advantages over known coolers. First, the cooler 100 has significantly more exterior advertising space than known coolers. As described above, advertising indicia 570 can be placed on the shell 110, on the loading doors 200, on the advertising panel 550, and even on the vent 560. Further, because the loading doors 200 are angled, a consumer can see the advertising indicia 570 from any position 180 degrees in front of the cooler 100. The use of the central access door 190, in combination with the convex loading doors 200, draws the consumer in towards the cooler 100. The cooler 100 is thus significantly different from known coolers in that most coolers use as large an access door as possible, such the consumer can see within the cooler. Although being able to see within the cooler may be able to attract the consumer, the use of the large doors limits the amount of advertising space on the cooler as a whole.

The use of the product loading system 300 insures that the products 400 are used in a first in and first out manner. This arrangement guarantees that the products 400 are used in a timely and efficient manner. Further, the cooler 100 provides for easy reloading in that the loading end 330 of the neck tracker tubes 320 is immediately and easily accessible. Many coolers require a rotation of existing products that may be both difficult and time consuming.

The use of the loading sections 170 also may limit the electricity consumed by the cooler 100 as a whole. The loading sections 170 need not be refrigerated such that the refrigeration system 130 need only cool the access section 125. Any reduction in the amount of space that needs to be cooled will greatly reduce the energy demands on the cooler 100 as a whole. Further, this reduction in the refrigeration of the interior portion 120 is done without limiting the overall capacity or storage space of the cooler 100. The products 400 may be stored in the loading sections 170 at ambient temperature until needed in the access section 125. The product 400 will be chilled adequately by the time it reaches the dispensing cup 350 given the length of the neck tracker tube 320 and the other products 400 positioned therein. Further, the use of the LED lighting 450 also decreases the energy demands of the cooler 100 as a whole.

The use of the dispensing cup 350 also promotes easy access to the products 400. A consumer does not need to remove the bottle 410 from the neck tracker tube 320. Rather, the consumer merely needs to pick the bottle 410 up directly from the dispensing cup 350. This ease of access also promotes the sale and use of the product 400.

The product loading system 300 also can accommodate other types of products 400 such as conventional beverage cans. For example, instead of the neck tracker tubes 320, a conventional flat rail may be used so as to roll the cans down from the loading end 330 to the dispensing end 340. Many other configurations also may be used for the product loading system 300 depending upon the product 400 used therein.

FIGS. 9 through 13 show an alternative embodiment of the present invention, a cooler 500. The cooler 500 may be identical to the cooler 100 described above with the exception that the cooler 500 is much narrower in width. For example, if the cooler 100 had a width of approximately fifty-two (52) inches, the cooler 500 may have a width of only about twenty-seven (27) inches. As described above, the cooler 500 may have an insulated shell 510 enclosing an interior portion 520 with a refrigerated access section 530 and one or more loading sections 540. The access section 530 is enclosed by an access door 550 and the loading sections 540 are enclosed by one or more loading doors 560. The loading doors 540 may be decorative in nature or display advertising indicia as described above. The insulated shell 510 may be similar to that sold by the Beverage-Air Company of Spartanburg, S.C. with coolers under the mark "MT27."

Figure 11:
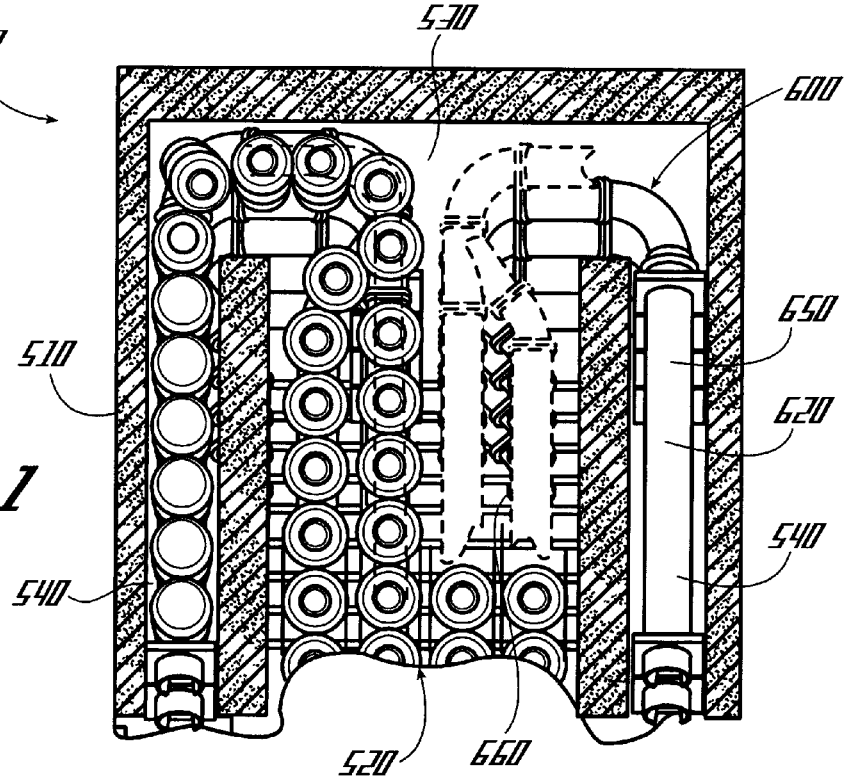
FIG. 11 is a top cross-sectional view of the cooler of FIG. 10 taken along line 11—11.
Figure 12:
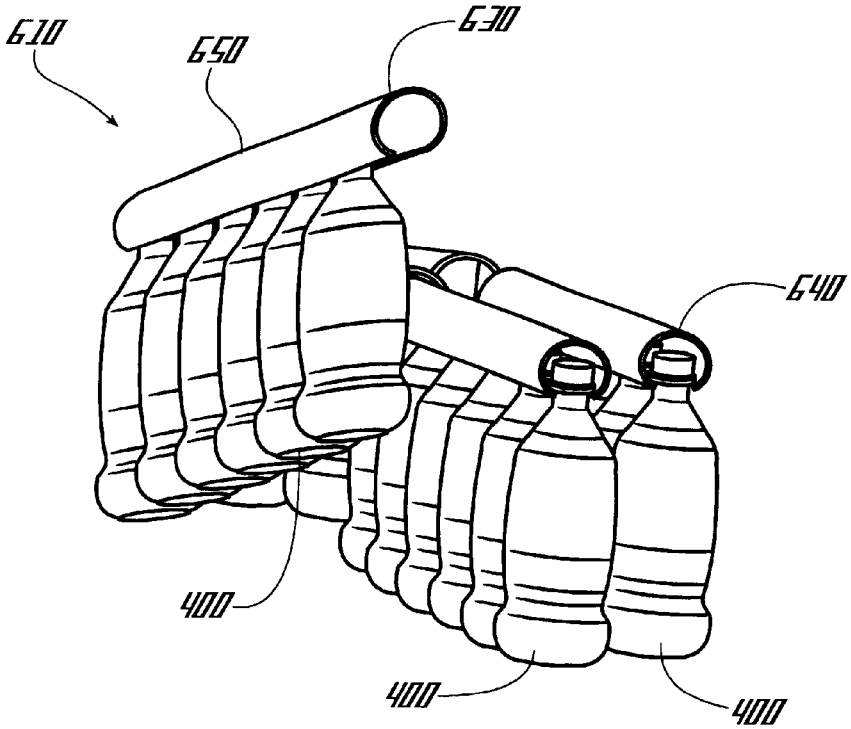
FIG. 12 is a perspective view of the alternative embodiment of the product loading system.
Figure 13:
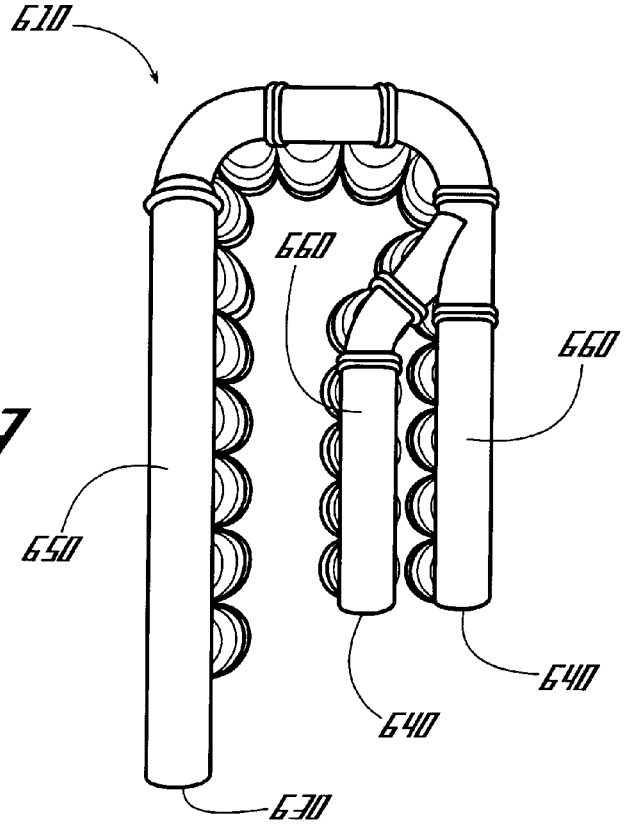
FIG. 13 is a top plan view of the alternative embodiment of the product loading system.

The cooler 500 may have a product loading system 600. The product loading system 600 may include a gravity feed loading system 610. In this embodiment, the gravity feed loading system 610 includes a plurality of neck tracker tubes 620. Similar to the neck tracker tubes 320 described above, these tubes 620 also extend from a higher loading end 630 to a lower dispensing end 640. In this embodiment, the neck tracker tubes 620 have a single loading tube 650 positioned within the loading end 630 and a plurality of dispensing tubes 660 positioned within the dispensing end 640. Specifically, the loading tube 650 splits into the plurality of dispensing tubes 660 in the dispensing end 640. Although two dispensing tubes 660 are shown in FIGS. 11–13, any number of dispensing tubes 660 may be used. The neck tracker tube 620 also may be used with the dispensing cups 350.

As the products 400 are removed from the dispensing end 640, further products 400 descend down the neck tracker tubes 620 into the dispensing tubes 660. The use of the multiple dispensing tubes 660 with one loading tube 650 thus allows the loading section 540 to be relatively narrow. This embodiment therefore allows the use of a narrower cooler 500 as a whole while still employing the use of the gravity feed loading system 610.

It should be apparent that the foregoing relates only to the preferred embodiments of the present invention and that numerous changes and modifications may be made herein without departing from the spirit and scope of the invention as defined by the following claims.

We claim:

1. A cooler, comprising:

an insulated shell;

said insulated shell comprising an access portion and a separate loading portion; and a product loading system;

said product loading system comprising a gravity-feed loading element and a dispensing cup.

2. The cooler of claim 1, wherein said access portion and said loading portion both comprise a chilled temperature.

3. The cooler of claim 1, wherein said loading portion comprises an ambient temperature.

4. The cooler of claim 1, wherein said insulated shell comprises a wall positioned therein between said access portion and said loading portion.

5. The cooler of claim 1, further comprising a plurality of loading portions.

6. The cooler of claim 1, further comprising an access door positioned on said insulated shell and adjacent to said access portion.

7. The cooler of claim 1, further comprising a loading door positioned on said insulated shell and adjacent to said loading portion.

8. The cooler of claim 7, wherein said loading door comprises an advertising panel.

9. The cooler of claim 7, wherein said loading door comprises a substantially convex shape.

10. The cooler of claim 7, further comprising a plurality of loading portions and a plurality of loading doors, with one of said loading doors positioned adjacent to each of said loading portions.

11. The cooler of claim 1, further comprising an access door positioned on said insulated shell and adjacent to said access portion and further comprising two loading portions positioned on either side of said access portion with a loading door positioned adjacent to each of said loading portions.

12. The cooler of claim 11, wherein each of said loading doors comprises a convex shape so as to define a chamber adjacent to said access door.

13. The cooler of claim 1, wherein said gravity-feed loading element comprises a neck tracker tube.

14. The cooler of claim 13, wherein said neck tracker tube comprises a U-shape.

15. The cooler of claim 13, wherein said neck tracker tube comprises a loading end positioned within said loading portion and a dispensing end positioned within said access portion.

16. The cooler of claim 15, wherein said loading end comprises an elevation from said dispensing end of about seven to about nine degrees.

17. The cooler of claim 15, wherein said dispensing cup comprises a position adjacent to said dispensing end of said neck tracker tube.

18. The cooler of claim 15, wherein said neck tracker tube comprises a plurality of dispensing ends positioned within said access portion.

19. The cooler of claim 15, wherein said neck tracker tube comprises a plurality of dispensing tubes positioned within said access portion.

20. The cooler of claim 1, wherein said product loading system comprises a plurality of gravity-feed loading elements and a plurality of dispensing cups.

21. The cooler of claim 1, wherein said dispensing cup comprises a base and a support rail.

22. The cooler of claim 1, further comprising a plurality of products positioned within said product loading system.

23. The cooler of claim 22, wherein said plurality of products comprises a plurality of bottles.

24. The cooler of claim 1, further comprising a light emitting diode positioned within said insulated shell.

25. The cooler of claim 1, further comprising a scuff panel positioned about said insulated shell.

26. The cooler of claim 1, further comprising advertising indicia positioned thereon.

27. A loading system for a plurality of bottles in a cooler, comprising;

an interior section of said cooler;

said interior section comprising a loading area and a distinct dispensing area;

a gravity feed element;

said gravity feed element comprising a loading end positioned within said loading area and a dispensing end positioned within said dispensing area; and a dispensing cup positioned adjacent to said dispensing end of said gravity feed element.

28. The loading system for a plurality of bottles of claim 27, wherein said gravity feed element comprises a neck tracker tube.

29. The loading system for a plurality of bottles of claim 28, wherein each of said plurality of bottles comprises a neck portion and a base portion.

30. The loading system for a plurality of bottles of claim 29, wherein said neck tracker tube comprises a C shape so as to support each of said plurality of bottles by said neck portion.

31. The loading system for a plurality of bottles of claim 29, wherein said dispensing cup comprises a base so as to support each of said plurality of bottles by said base portion.

32. The loading system for a plurality of bottles of claim 27, wherein said loading end of said gravity feed element comprises a higher position than said dispensing end of said gravity feed element such that said plurality of bottles slides from said loading end to said dispensing end.

33. The loading system for a plurality of bottles of claim 27, wherein said loading end of said gravity feed element comprises an ambient temperature and said dispensing end of said gravity feed element comprises a chilled temperature.

34. The loading system for a plurality of bottles of claim 27, wherein said dispensing cup extends beyond said gravity feed element such that said gravity feed element does not interfere with the removal of one of said plurality of bottles from said dispensing cup.

35. The loading system for a plurality of bottles of claim 27, further comprising a plurality of gravity feed elements and a plurality of dispensing cups.

36. The loading system for a plurality of bottles of claim 27, wherein said gravity feed element comprises a plurality of dispensing ends.

37. A method for storing a plurality of products in a cooler, said cooler having a product loading system extending from a loading end within a first section to a dispensing end within a distinct second section and having a dispensing cup positioned adjacent to said dispensing end, said method comprising the steps of:

loading said plurality of products into said loading end of said product loading system;

sliding said plurality of products from said loading end to said dispensing end of said product loading system;

sliding a first one of said plurality of products from said dispensing end of said product loading system to said dispensing cup; and removing said first one of said plurality of products from said dispensing cup.

38. The method for storing a plurality of products in a cooler of claim 37, further comprising the step of sliding a second one of said plurality of products from said product loading system to said dispensing cup after said first one of said plurality of products has been removed.

39. A cooler for housing a plurality of products, comprising:

an insulated shell;

an access door; and a light emitting diode positioned within said insulated shell so as to illuminate said plurality of products.

40. The cooler of claim 39, further comprising a plurality of light emitting diodes.

* * * * *